US006672945B1

(12) United States Patent
Matsuo et al.

(10) Patent No.: US 6,672,945 B1
(45) Date of Patent: Jan. 6, 2004

(54) POLISHING APPARATUS AND DRESSING METHOD

(75) Inventors: Hisanori Matsuo, Kanagawa (JP); Hirokuni Hiyama, Tokyo (JP); Yutaka Wada, Kanagawa (JP); Kazuto Hirokawa, Kanagawa (JP)

(73) Assignee: Ebara Corporation, Tokyo (JP)

( * ) Notice: Subject to any disclaimer, the term of this patent is extended or adjusted under 35 U.S.C. 154(b) by 49 days.

(21) Appl. No.: 09/641,347

(22) Filed: Aug. 18, 2000

(30) Foreign Application Priority Data

Aug. 20, 1999 (JP) ..... 11-234564
Aug. 11, 2000 (JP) ..... 2000-244831

(51) Int. Cl.[7] ..... B24B 1/00; B24B 7/00

(52) U.S. Cl. ..... 451/56; 451/41; 451/53; 451/72; 451/443

(58) Field of Search ..... 451/21, 41, 53, 451/56, 72, 57, 285, 286, 287, 288, 289, 290, 443, 444, 450, 488; 216/88, 89; 438/692, 693

(56) References Cited

U.S. PATENT DOCUMENTS

| | | | | |
|---|---|---|---|---|
| 5,081,051 | A | | 1/1992 | Mattingly et al. |
| 5,216,843 | A | | 6/1993 | Breivogel et al. |
| 5,984,764 | A | | 11/1999 | Saito et al. |
| 6,126,523 | A | * | 10/2000 | Moriyasu et al. ..... 451/443 |

FOREIGN PATENT DOCUMENTS

| | | | |
|---|---|---|---|
| JP | 61-152367 | * | 11/1986 |
| JP | 10-71557 | | 3/1998 |
| JP | 10-175155 | | 6/1998 |
| JP | 10-217103 | | 8/1998 |
| WO | 98/16347 | | 4/1998 |

OTHER PUBLICATIONS

Patent Abstracts of Japan, JP 7230973 A (Toshiba KK) Aug. 29, 1995.

* cited by examiner

*Primary Examiner*—Timothy V. Eley
(74) *Attorney, Agent, or Firm*—Wenderoth, Lind & Ponack, L.L.P.

(57) ABSTRACT

A abstract polishing apparatus has a substrate carrier a substrate and an abrasive member having a polishing surface. The surface is slidingly engaged with the substrate in order to effect polishing. The dressing device includes a light source when generating light rays for irradiating the polishing surface of the abrasive member, whereby dressing the polishing surface. A temperature control system control the temperature of the polishing surface of the abrasive member by sensing the temperature of the polishing surface with the temperature sensor. Mechanical dressing of the polishing surface, in addition to dressing by radiation of the polishing surface, may also be employed in order to flatten the entire polishing surface. The abrasive member preferably includes an abrasive particles, a binder and a photophilic for promoting the dressing of the polishing surface by light rays.

18 Claims, 16 Drawing Sheets

POLISHING APPARATUS AND DRESSING METHOD

BACKGROUND OF THE INVENTION

The present invention relates to a polishing apparatus for polishing a substrate, e.g. a semiconductor wafer, in which a fixed abrasive member or an abrasive polishing disc is employed. More particularly, the present invention relates to an arrangement of a dressing member used for dressing (regenerating) the fixed abrasive member, and relates also to a method of dressing the abrasive disc.

With recent rapid progress in technology for fabricating high-integration semiconductor devices, circuit wiring patterns have become increasingly fine. To produce such fine circuit wiring patterns, it is necessary for the surface of a substrate on which such patterns are formed to be exceptionally flat. To this end, a so-called chemical/mechanical polisher (CMP) has been widely employed. A chemical/mechanical polisher (CMP) comprises a turntable provided with a polishing cloth (pad) bonded thereto and a substrate carrier. The substrate carrier is designed to hold a semiconductor substrate to be polished and bring it into contact with the polishing cloth. During a polishing operation, a chemical polishing liquid (slurry) containing abrasive particles is supplied to the polishing pad, and a surface of a substrate subject to a polishing operation is polished until it becomes flat and specular.

However, in conventional chemical/mechanical polishers (CMPs), there is a tendency for a "pattern dependency" problem to arise. Namely, an area on which a wiring pattern having small pattern pitches is provided is subject to a relatively high degree of polishing, while an area provided with a wiring pattern having a large pattern of pitches is subject to a relatively low degree of polishing, which creates inconsistencies in the form of undulations on the polished surface of the semiconductor substrate. As a result, it is difficult to obtain a polished surface having the requisite degree of flatness. Further, in a chemical/mechanical polisher (CMP) employing a polishing pad, when a substrate on which a circuit pattern has been formed and thus there exist raised portions and recessed portions on the surface of the substrate, not only are the raised portions polished, but also the recessed portions. This makes it impossible to cause the polisher to realize a so-called self-stop function whereby the polisher substantially stops its polishing function or the polishing rate becomes nearly zero when the raised portions have been sufficiently polished to thereby attain a high degree of flatness of the substrate surface.

As an alternative to a conventional CMP, research has been conducted with a view to polishing semiconductor wafers or the like by means of a fixed abrasive member comprising abrasive particles of, for example, cerium oxide ($CeO_2$) bonded by a binder such as a phenolic resin. As compared with a conventional chemical/mechanical polishing device wherein a polishing pad is utilized, use of a fixed abrasive member is advantageous in that it is relatively easy to attain the requisite degree of flatness of a polished surface since recessed portions formed in a circuit pattern area are not subject to polishing. In addition, if fixed abrasive members are used in conjunction with particular kinds of abrasive particles, it is possible to realize the so-called self stop noted above. Furthermore, in utilizing a fixed abrasive member no polishing slurry is required, which is environmentally advantageous.

However, in a semiconductor wafer polishing process using a fixed abrasive member, the polishing efficiency, although high just after dressing of the fixed abrasive member, gradually deteriorates. Accordingly, in order to maintain efficient and effective polishing, it is necessary to dress or condition the fixed abrasive member before each polishing operation by using, for example, a dressing member including a number of diamond particles bound to its surface so as to generate a sufficient quantity of free or loose abrasive particles. However, carrying out dressing of the fixed abrasive member before each polishing operation is inefficient and has a negative effect on productivity.

Furthermore, using a dressing member provided with diamond particles to regenerate the surface of a rigid polishing member involves a problem in that the diamond particles are liable to become detached and scratch or otherwise damage the surface of a substrate to be polished.

SUMMARY OF THE INVENTION

In view of the above-described circumstances, an object of the present invention is to provide a substrate polishing apparatus using a fixed abrasive member which is free from the problem that diamond particles may detached from the abrasive member and fall onto the polishing surface, and which is capable of stably freeing abrasive particles from the polishing surface of the abrasive member, thereby allowing polishing to be performed at a stabilized polishing rate, and also to provide an abrasive member dressing method.

Another object of the present invention is to provide a dressing apparatus or method capable of appropriately freeing abrasive particles from an abrasive member and thus increasing the lifetime of the abrasive member.

In dressing of the fixed abrasive member, the dressing member surface is slidingly engaged with the polishing surface of the abrasive member, thereby freeing a sufficient amount of abrasive particles from the abrasive member. Thus, in accordance with this invention, it becomes possible to eliminate the likelihood of detachment of diamond particles, such as is likely to occur in using a conventional diamond dressing member, and accordingly it is possible to prevent scratches or other damage from being created on a surface of a substrate to be polished. As the dressing member, it is preferable to use a ceramic dressing member consisting essentially of SiC or diamond-like carbon.

According to another aspect of the present invention, there is provided a substrate polishing apparatus comprising a fixed abrasive member having a polishing surface, the polishing surface being slidingly engaged with a substrate to be polished, and a dressing member having a dressing surface adapted to be slidingly engaged with the polishing surface of the fixed abrasive member for dressing the polishing surface of the abrasive member. The dressing member is in the shape of a rod extending from a center of the abrasive member to an outer periphery thereof. Thus, the rod-shaped dressing member and the surface to be dressed of the abrasive member come into linear contact with each other uniformly over the entire radius of the abrasive member. This enables the dressing member to dress the abrasive member uniformly.

According to another aspect of the present invention, there is provided a substrate polishing apparatus comprising a substrate carrier for carrying a substrate, a fixed abrasive member having a polishing surface, the polishing surface being slidingly engaged with a substrate carried by the substrate carrier for effecting polishing, and a dressing member having a dressing surface adapted to be slidingly engaged with the polishing surface of the fixed abrasive member for dressing the polishing surface. The dressing member is in the shape of a ring and provided on the substrate carrier in such a manner that the dressing member is placed around the substrate with the dressing surface being set flush with a surface of the substrate to be polished. In this polishing apparatus, abrasive particles are effectively and appropriately liberated from the abrasive member while effecting polishing.

According to another aspect of the present invention, there is provided a method for dressing a polishing surface of a fixed abrasive disc in a substrate polishing apparatus wherein a substrate is brought into engagement with the polishing surface of the fixed abrasive disc rotating about its axis while rotating the substrate. The method comprises the steps of preparing a dressing member having a dressing surface, bringing the dressing surface of the dressing member into engagement with the polishing surface of the rotating fixed abrasive disc and controlling the ratio of the number of revolutions of the dressing member to a number of revolutions of the fixed abrasive disc so as to adjust the dressing conditions. In such a way, the surface configuration of the abrasive disc can be adjusted to the desired configuration, whereby even when the polishing surface of the abrasive disc is not flat, the substrate surface can be polished to the requisite degree of flatness.

Preferably, the dressing surface of the dressing member is engaged with the polishing surface of the rigid rotating abrasive disc under a pressure of not more than 30 g/cm$^2$ so as to improve the stability of the polishing rate and to increase the lifetime of the abrasive disc.

According to a further aspect of the present invention, there is provided a method for dressing a polishing surface of a fixed abrasive member used in a substrate polishing process wherein a substrate is brought into engagement with the polishing surface of the fixed abrasive member and subjected to a relative sliding motion therebetween, thereby causing the substrate to be polished. The method comprises supplying the polishing surface of the fixed abrasive member with a liquid capable of dissolving a binder binding abrasive particles and forming the polishing surface of the fixed abrasive member to promote the generation of freed abrasive particles. In this method, it is not necessary to employ a dressing member.

According to another aspect of the present invention, there is provided a method for dressing a polishing surface of a fixed abrasive member used in a substrate polishing process wherein a substrate is brought into engagement with the polishing surface of the fixed abrasive member and subjected to a relative sliding motion therebetween, thereby causing the substrate to be polished. The method comprises passing an electric current through the fixed abrasive member, thereby breaking bonds of a binder binding abrasive particles of the fixed abrasive member to promote the generation of freed abrasive particles.

According to another aspect of the present invention, there is provided a method for dressing a polishing surface of a fixed abrasive member used in a substrate polishing process wherein a substrate is brought into engagement with the polishing surface of the fixed abrasive member and subjected to a relative sliding motion therebetween, thereby causing the substrate to be polished. The method comprises the steps of preparing the fixed abrasive member containing photocatalyst in the polishing surface made of abrasive particles bound by a binder and irradiating the polishing surface of the fixed abrasive member, thereby breaking bond of the binder in the polishing surface to promote the generation of freed abrasive particles.

The above and other objects, features and advantages of the present invention will become more apparent from the following description of the preferred embodiments thereof, taken in conjunction with the accompanying drawings.

BRIEF DESCRIPTION OF THE DRAWINGS

FIG. 2(*b*) is a side elevational view of the apparatus of FIG. 2(*a*).

FIG. 6(*b*)is a cross sectional side elevation view of a modification of the polishing apparatus of FIG. 6(*a*).

FIG. 7(*b*) is a cross sectional side elevation view of a plan view of the modification of the apparatus of FIG. 7(*a*).

FIG. 9(*b*) is a cross sectional side elevation view of the apparatus of FIG. 9(*a*).

FIG. 10(*b*) is a diagram showing a relationship between the dressing surface pressure and the rate of polishing.

DETAILED DESCRIPTION OF THE INVENTION

Figure 1A:
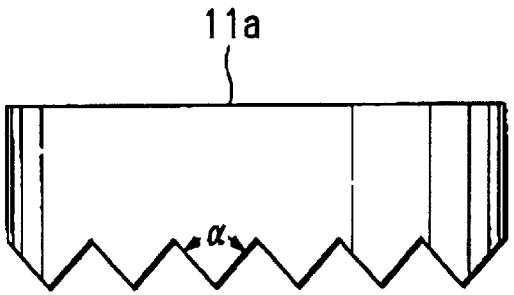
FIGS. 1(*a*), 1(*b*), 1(*c*) and 1(*d*) are sectional views showing various configurations of dressing surfaces of dressing members according to a first embodiment of the present invention.
Figure 1B:
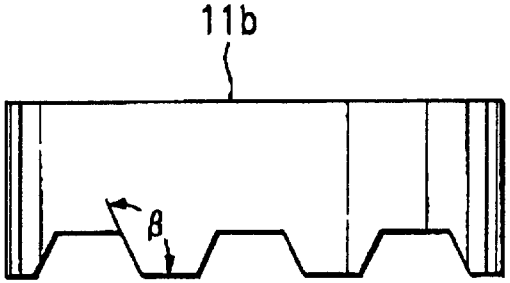
Figure 1C:
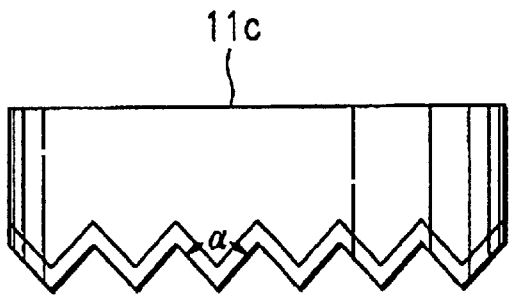
Figure 1D:
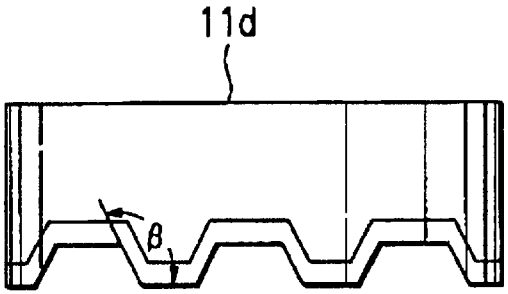

Embodiments of the present invention will be described below with reference to the accompanying drawings.

FIG. 1 shows various configurations of dressing surfaces of a ceramic dressing member according to a first embodiment of the present invention. These dressing surfaces are, as shown, provided with a plurality of projections having an angle or angles of not less than 100°. The dressing member is used to dress or condition a fixed abrasive member, which includes a rigid member or base member and a number of abrasive particles adhered to the rigid member and is employed in a substrate polishing apparatus for use in polishing a semiconductor substrate, by slidingly engaging, the dressing surface thereof with the fixed abrasive member. FIG. 1(*a*) shows a triangular wave-shaped dressing surface. FIG. 1(*b*) shows a rectangular wave-shaped dressing surface. More specifically, the ceramic dressing member 11*a* has a triangular wave-shaped dressing surface comprising a plurality of triangular projections each having an obtuse angle $\alpha$ of not less than 100°. Similarly, the ceramic dressing member 11*b* has a rectangular wave-shaped dressing surface comprising a plurality of rectangular projections having obtuse angles $\alpha$ of not less than 100°. The ceramic dressing member is preferably made from SiC, with the said projections having a height of around 0.5 mm and a pitch of about 0.5 mm as shown in FIGS. 1(*a*) and (*b*).

Using the ceramic dressing member with dressing surfaces 11*a*, 11*b* it is possible to liberate a sufficient amount of abrasive particles from a fixed abrasive member by simply sliding the dressing surfaces against the projections on the polishing surface of the fixed abrasive member, as opposed to an operation in which a conventional polishing pad is utilized wherein it is necessary for a dressing member to abrade the surface of the polishing pad by means of diamond particles which are provided, for example, on the dressing member. As stated above, these diamond particles are liable to become detached from the dressing member, fall onto the surface of a polishing pad and thereby cause damage in the form of scratches or otherwise to the surface of a semiconductor substrate surface during a subsequent polishing operation.

FIGS. 1(*c*) and 1(*d*) show dressing members 11*c* and 11*d*, respectively, each having a coating layer 12 of a diamond like carbon (DLC) or similar material formed on a metal base by a so-called dynamic mixing method or other film forming method. The angles $\alpha$ and $\beta$ in the coating layers 12 each form an obtuse angle of not less than 100°, as is the case in FIGS. 1(*a*) and 1(*b*). The use of the dressing member 11*c* or 11*d* coated with diamond-like carbon by, for example, the dynamic mixing method also eliminates the likelihood of detachment of the diamond particles, such as is likely to occur in using a conventional diamond dressing member. Accordingly, it is possible to prevent scratches or other damage from being created on a surface of a substrate to be polished. In addition, a sufficient number of free or loose abrasive particles can be generated.

Figure 2A:
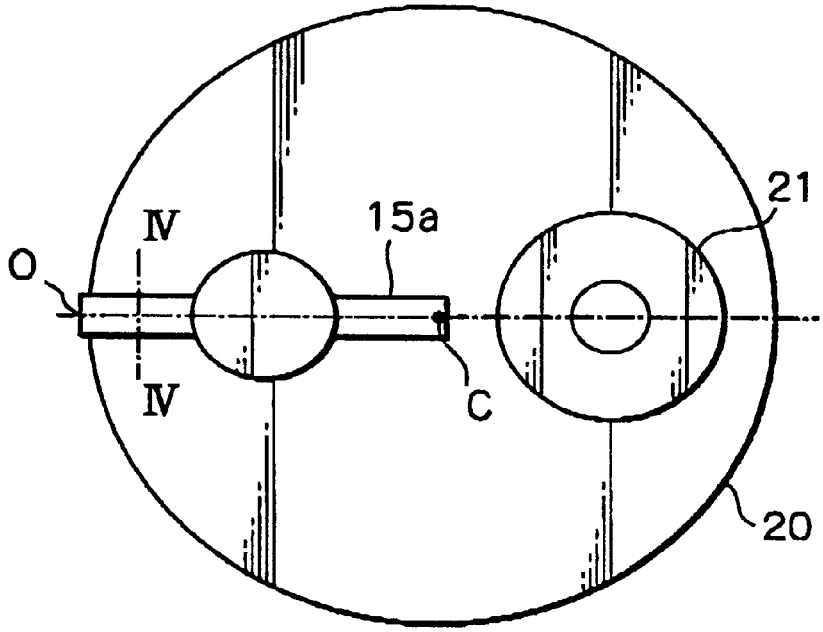
FIG. 2(*a*) is a plan view of a polishing apparatus having a rod-shaped dressing member according to a second embodiment of the present invention.
Figure 2B:
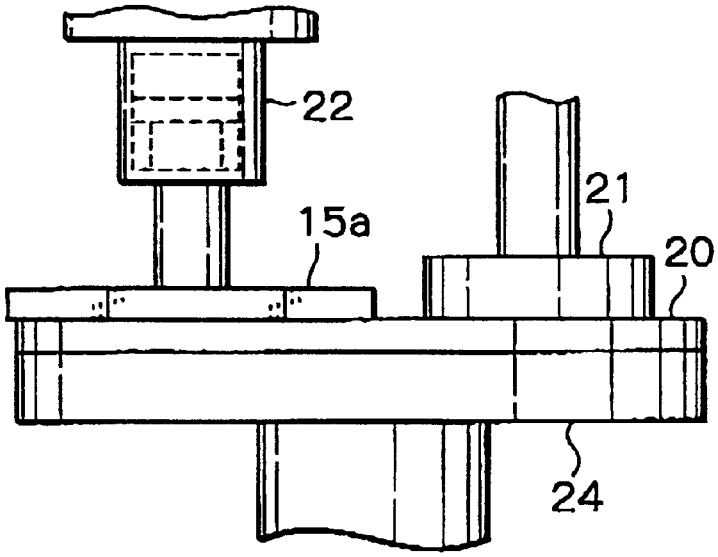
Figure 3A:
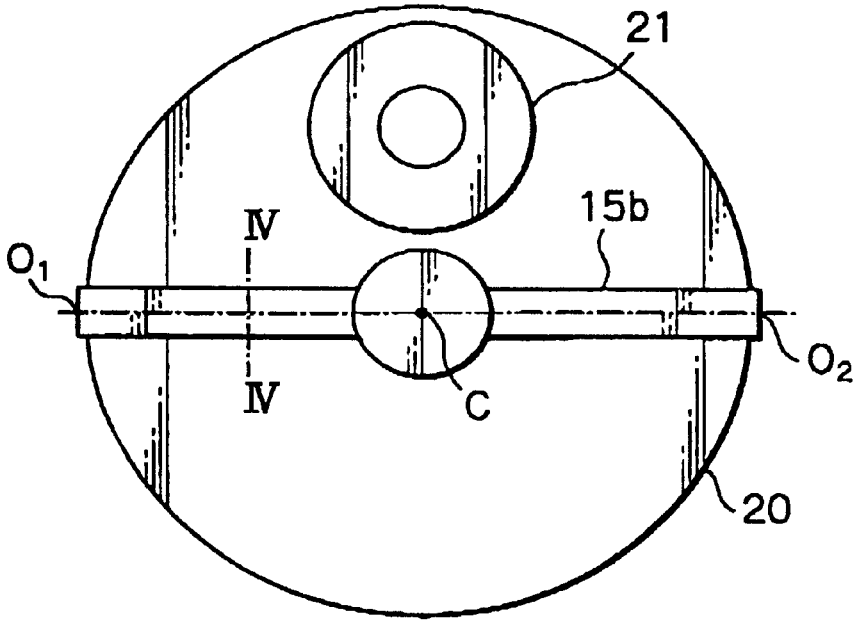
FIG. 3(*a*) is a plan view of a modification of the polishing apparatus illustrated in FIG. 2, FIG. 3(*b*) is a side elevational view of the apparatus of FIG. 3(*a*).
Figure 3B:
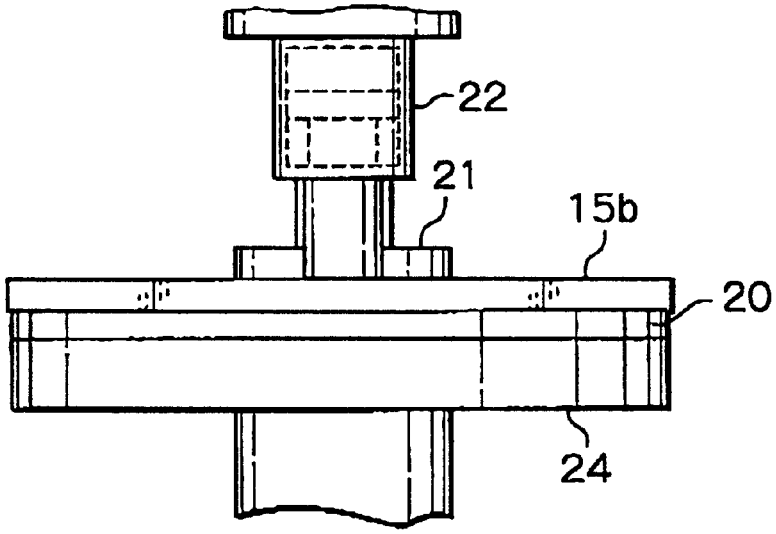

FIGS. 2 to 5 show a polishing apparatus according to a second embodiment of the present invention. FIGS. 2 and 3 show a substrate polishing apparatus wherein a surface of a substrate is polished by placing the substrate surface on the polishing surface of a fixed abrasive disc 20 under pressure. The abrasive disc 20 is bonded to a turntable 24. A substrate to be polished (not shown) is held by a substrate carrier 21 and brought into contact with the polishing surface of the abrasive disc 20 under the operation of an actuator (not shown). The turntable 24 and the substrate carrier 21 rotate about their own axes. Consequently, the surface to be polished of the substrate and the abrasive disc 20 are caused to slide against each other, thereby polishing the surface of the substrate to be polished.

In general, a polishing apparatus is provided with a dressing member for dressing a fixed abrasive disc, with the abrasive disc being dressed prior to a polishing operation. As has been stated above, because the abrasive disc is generally rigid in comparison with a polishing cloth (pad) of a conventional CMP apparatus, the abrasive disc itself is required to be flat in order for a substrate surface to be polished to a requisite degree of flatness. However, in the conventional dressing process a dressing member with a disk-shaped dressing surface having a diameter which is smaller than the radius of the abrasive disc is generally used. As a result, the dressing surface is able to be applied to only a part of an actual area of a polishing surface of the abrasive disc. This means that a dressing operation may not be carried out uniformly across the entire surface of the abrasive disc. To solve this problem, as shown in FIGS. 2 and 3, a rod-shaped dressing member 15*a* or 15*b* extending from the center of the abrasive disc 20 to the outer periphery thereof is used.

FIGS. 2(*a*) and 2(*b*) shows an example in which a-rod-shaped dressing member 15*a* extends from the center C of the abrasive disc 20 to the outer periphery O. Similarly, FIGS. 3(*a*) and 3(*b*) shows an example in which a rod-shaped dressing member 15*b* extends diametrically to the abrasive disc 20 between the outer peripheral surfaces $\mathbf{0}_1$, and $\mathbf{0}_2$, passing through the center C of the abrasive disc 20. A substrate carrier 21 holds a substrate to be polished. The substrate carrier 21 rotates about its own axis while pressing the substrate against the polishing surface of the abrasive disc 20 under a predetermined pressure. Consequently, the substrate slides against the polishing surface of the abrasive disc 20, which is also rotating, and thus polishing of the substrate proceeds, as stated above. In a dressing operation, the rod-shaped dressing member 15*a* or 15*b* is activated by a pressing cylinder 22, at which time the abrasive disc 20 secured to the turntable 24 is rotated. In this manner, the polishing surface of the abrasive disc 20 is dressed. Because the rod-shaped dressing member 15*a* or 15*b* and the surface to be dressed of the abrasive disc 20 come in line contact with each other uniformly over the entire radius of the abrasive disc 20, it is possible to dress the abrasive disc 20 uniformly in its radial direction. Moreover, dressing can be performed in an in-situ state while the substrate held by the substrate carrier 21 is being polished with the abrasive disc 20.

Figure 4:
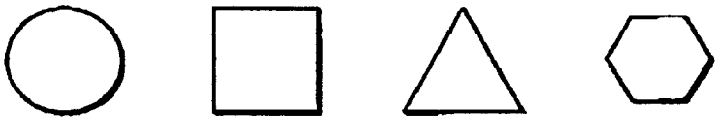
FIG. 4 is a diagram showing examples of the sectional configurations of rod-shaped dressing members taken along lines IV—IV in FIGS. 2 and 3.

FIG. 4 shows examples of sectional configurations of the rod-shaped dressing members shown in FIGS. 2(*a*) and (*b*) and 3(*a*) and (*b*), taken along lines IV—IV. As illustrated in the figure, the sectional configuration of the rod-shaped dressing members 15*a* and 15*b* may be circular, square, triangular or hexagonal. It is preferable for the rod-shaped dressing members 15*a* and 15*b* to be provided with one of the dressing surfaces shown in FIG. 1. However, the dressing surface of the rod-shaped dressing members 15*a* and 15*b* is not necessarily limited to those shown in FIG. 1.

Figure 5:
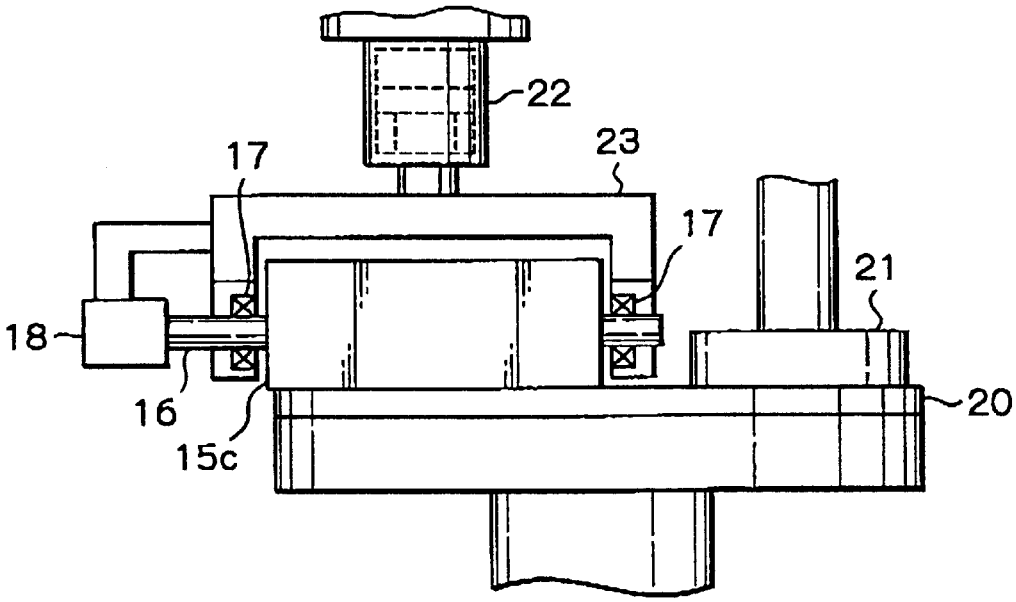
FIG. 5 is a side elevational view of another modification of the polishing apparatus illustrated in FIG. 2, in which the rod-shaped dressing member is in the shape of a roll.

FIG. 5 shows a structural example of a polishing apparatus including a rod-shaped dressing member which has a circular sectional configuration and which is rotatable about its axis. A rod-shaped dressing member 15*c* is a roller having a circular sectional configuration. The rod-shaped dressing member 15*c* has a center shaft 16 supported by bearings 17. The center shaft 16 is rotatively driven by a motor 18. The rotating rod-shaped dressing member (roller) 15*c* is pressed against a polishing surface of an abrasive disc 20 by means of a pressing cylinder 22 through a support portion 23. The abrasive disc 20 is secured to a turntable 24. Meanwhile, a substrate carrier 21 holds a substrate to be polished, e.g. a semiconductor wafer. The substrate carrier 21 rotates while pressing the substrate against the polishing surface of the abrasive disc 20. Thus, polishing proceeds. As will be apparent, in this polishing apparatus, the rod-shaped dressing member 15*c* itself rotates, and the abrasive disc 20 secured to the turntable 24 also rotates. Therefore, the dressing member 15*c* and the surface to be dressed of the abrasive disc 20 come into line contact with each other uniformly over the radius of the abrasive disc 20. In this manner an appropriate dressing operation can be provided with respect to the abrasive disc 20.

Figure 6A:
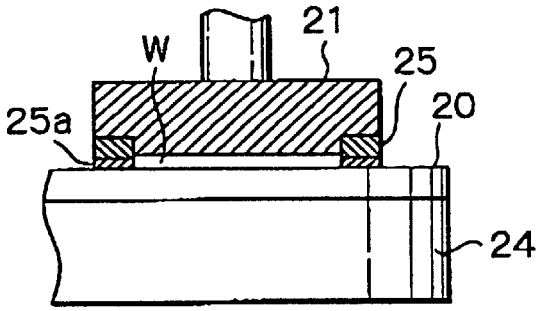
FIG. 6(*a*) is a cross sectional side elevation view of a polishing apparatus according to a third embodiment of the present invention.
Figure 6B:
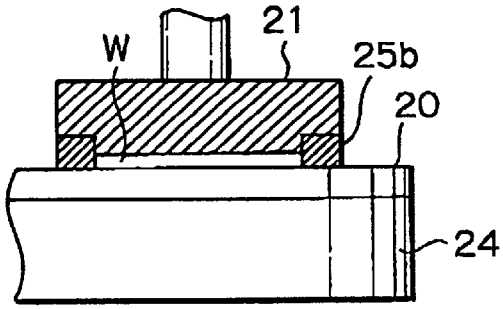

FIGS. 6(*a*) and (*b*) each show an essential part of a substrate polishing apparatus according to a third embodiment of the present invention, particularly a substrate carrier and proximate portions. In this polishing apparatus, a dressing member 25*a* is provided on the surface of a guide ring 25 provided on the outer periphery of a substrate carrier 21 for holding the outer peripheral portion of a substrate W to be polished. Alternatively, the guide ring itself can be formed from a dressing member 25*b*. In FIG. 6(*a*), a guide ring 25 is movably fitted to the outer peripheral portion of a substrate carrier 21 for pressing a semiconductor wafer W as a substrate to be polished against the polishing surface of an abrasive disc 20, while sliding the semiconductor wafer W across the polishing surface, and the dressing member 25*a* is fitted to the lower end surface of the guide ring 25. Accordingly, the dressing surface of the dressing member 25*a* slides across the polishing surface of the abrasive disc 20, thereby dressing the polishing surface of the abrasive disc 20. The dressing member 25*a* may consist of, for example, a dressing member provided with a coating layer of diamond-like carbon or a similar material on a metal base 25 by means of dynamic mixing or another film forming method.

FIG. 6(*b*) shows an example in which the guide ring is adapted to effect the function of a dressing member. For example, the guide ring is formed from a ceramic material, e.g. SiC and the lower end surface thereof is used as a dressing member surface. In this case also, the dressing surface of the guide ring 25*b* provided on the outer peripheral portion of a rotating substrate carrier 21 slides across the 5 polishing surface of an abrasive disc 20 provided on a rotating turntable 24, to thereby dress the polishing surface of the abrasive disc 20, as in the case of FIG. 6(*a*). In accordance with this invention, freed abrasive particles can be generated during polishing and effectively supplied to the interface between the substrate W to be polished and the abrasive disc 20.

Figure 7A:
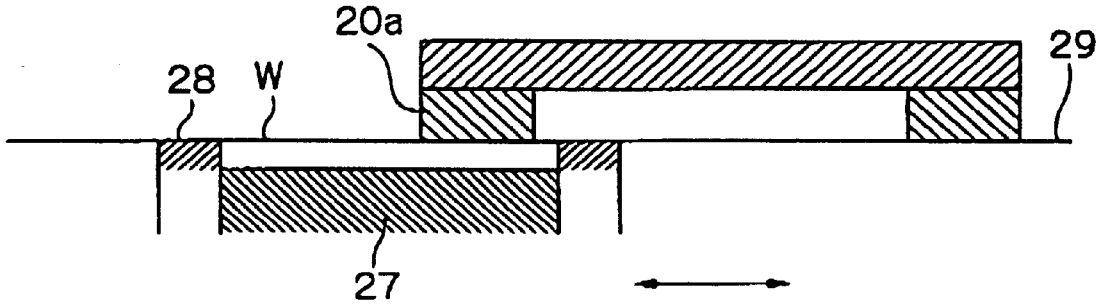
FIG. 7(*a*) shows a cross sectional side elevation view of another modification of the polishing apparatus of the present invention.
Figure 7B:
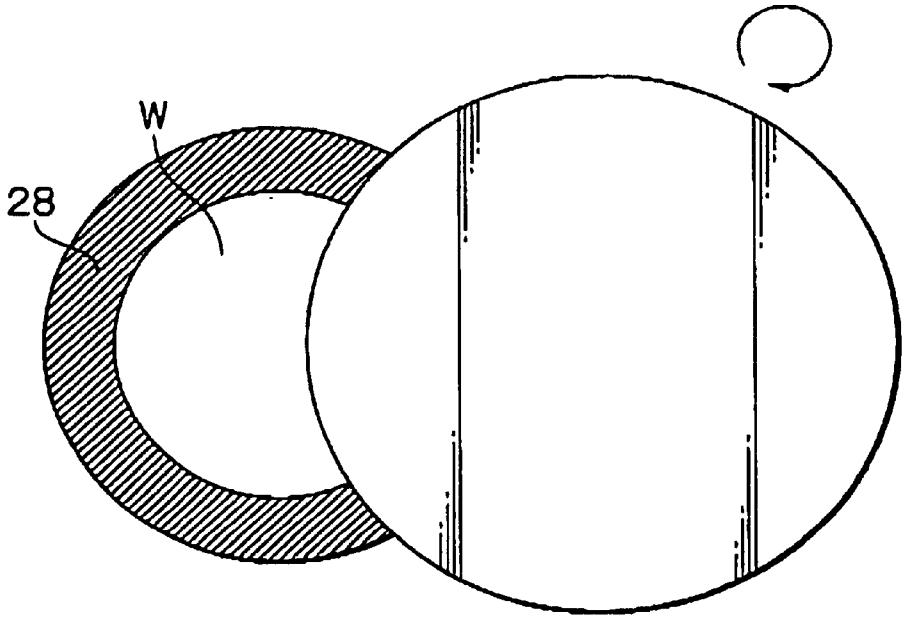

FIG. 7 shows another embodiment of the present invention. In this embodiment, there are provided an abrasive ring 20*a*, a substrate holder 27 and a dressing member 28. The dressing member 28 is provided in such a way as to surround the outer periphery of a substrate W as placed on the substrate holder 27 to serve as a guide ring for holding the substrate W. The dressing member 28 is provided with a dressing surface on the upper area thereof In this embodiment, the dressing member 28 is placed around the substrate W in such a manner that the dressing surface of the dressing member 28 is flush with the surface of the substrate W to be polished. The cup-shaped abrasive ring 20*a* is subject to a circular orbital motion or rotational 25 translational motion. Consequently, the abrasive ring 20*a* is dressed during polishing, with freed abrasive particles being generated and supplied to the surface undergoing polishing. Thus, because freed abrasive particles can be effectively supplied to the surface to be polished of the substrate W efficient polishing can be performed. It should be noted that in FIG. 7 the numeral 29 denotes a support plate which functions to keep the abrasive ring 20*a* flush with the surface of the substrate W to be polished.

Figure 8:
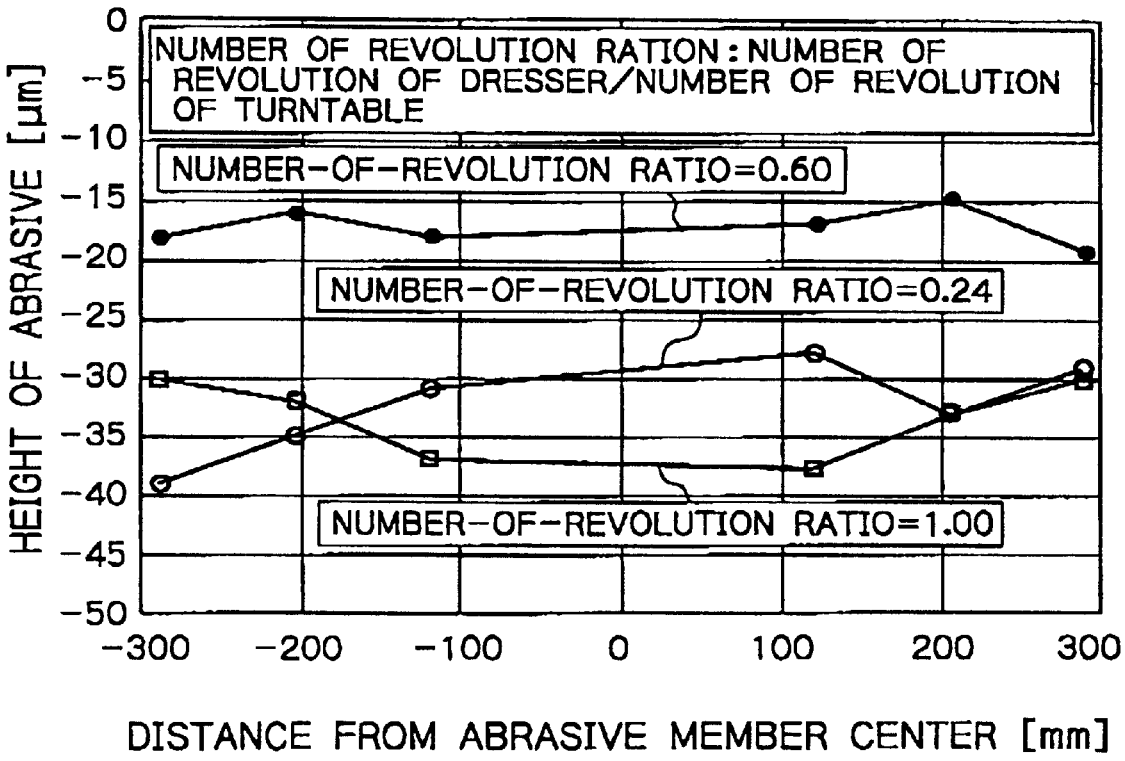
FIG. 8 is a diagram showing polished surface configurations varying according to the ratio of the number of revolutions of a dressing member to that of a turntable.
Figure 9A:
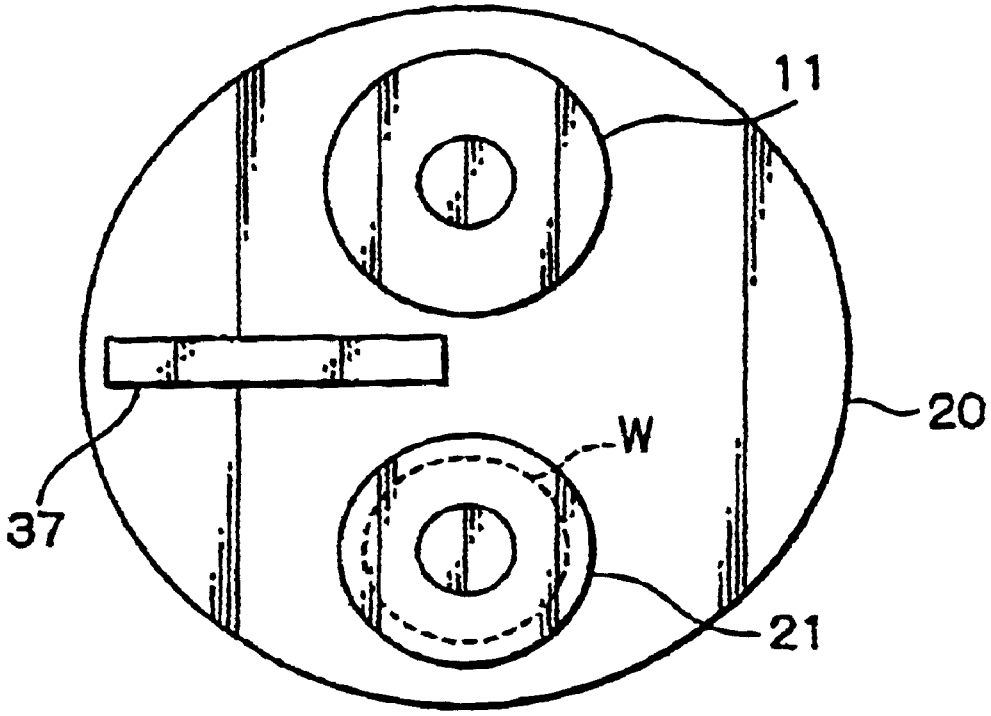
FIG. 9(*a*) is a plan view of a polishing apparatus according to a fourth embodiment of the present invention.
Figure 9B:
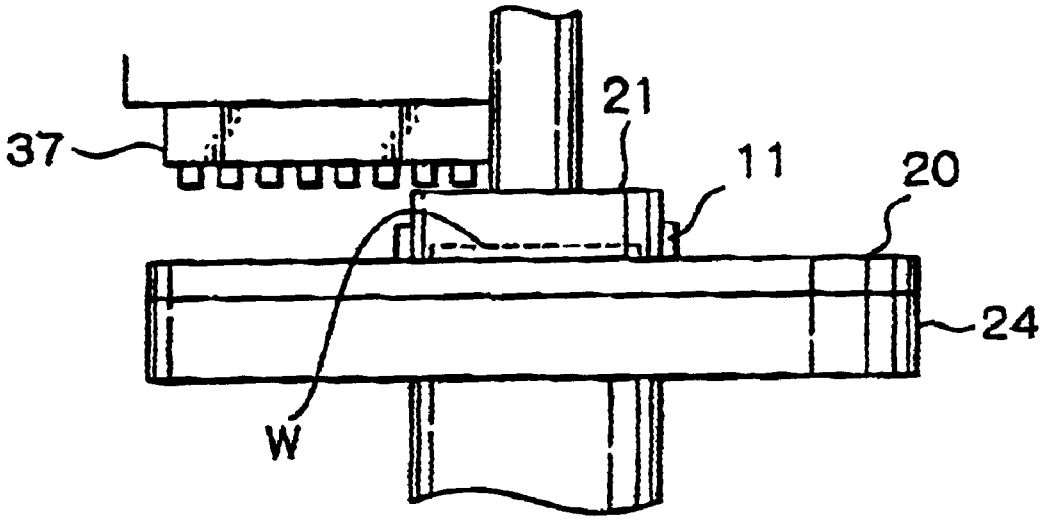

FIGS. 8 and 9 are diagrams illustrating a fourth embodiment of the present invention. In the process of polishing a substrate, e.g. a semiconductor wafer, using an abrasive disc, the configuration of the polished surface of the substrate is apt to vary in conformity with the surface configuration of the abrasive disc. The configuration of the polishing surface of the abrasive disc in turn varies according to the ratio of the number of revolutions of the turntable in rotating the abrasive disc to the number of revolutions of the dressing member. Thus, the surface configuration of the abrasive disc can be altered by controlling the ratio, thereby enabling the polished surface configuration of the substrate to be altered accordingly.

FIG. 8 shows the result of an experiment carried out to examine the relationship between the ratio of the number of revolutions of the dressing member to that of the turntable and the surface configuration of the abrasive disc. The abscissa axis shows the distance (mm) from the center of the abrasive disc, and the ordinate axis shows the height (in microns) of the surface of the abrasive disc. In FIG. 8, the relationship between the distance from the abrasive disc center and the height of the abrasive disc surface is shown using the number-of-revolutions ratio as a parameter. As will be understood from FIG. 8, when the number of revolutions of the dressing member is low with respect to the number of revolutions of the turntable, e.g. the number-of-revolutions ratio (the number of revolutions of the dressing member/the number of revolutions of the turntable)=0.24, the polishing surface of the abrasive disc assumes a general hill-like form, in which the central portion is highest.

When the ratio of the number of revolutions of the dressing member to that of the turntable is 0.60, which is an appropriate ratio, the polishing surface of the abrasive disc becomes approximately flat.

When the ratio of the number of revolutions of the dressing member to that of the turntable is 1.00, which is a relatively high ratio, the polishing surface of the abrasive disc is worn generally into a valley-like form, in which the central portion is lowest.

FIG. 9 shows a polishing apparatus having a sensor for measuring the abrasive disc surface configuration. In the apparatus, an abrasive disc 20 is bonded to a rotating turntable 24. A substrate W is held by a substrate carrier 21, which also rotates, and brought into contact with the abrasive disc 20 under pressure to effect polishing of the substrate. The polishing apparatus is capable of in-situ dressing, as defined above. The substrate carrier 21 for pressing a substrate W to be polished against the polishing surface of the abrasive disc 20, at the same time, slides the substrate W across the polishing surface of the abrasive disc 20. The polishing apparatus further has a dressing member 11 for dressing the polishing surface of the abrasive disc 20 by being slidingly engaged with the polishing surface under pressure. In addition, the polishing apparatus has an abrasive disc surface configuration-measuring sensor 37 for measuring the height of the surface of the abrasive disc 20 over an area of the disk-shaped abrasive disc 20 from the center to the outer periphery thereof.

Accordingly, it is possible to measure the distribution of height of the abrasive disc surface in every radial direction as the abrasive disc 20 rotates. During use of the polishing apparatus, the surface configuration of the abrasive disc 20 is measured by the sensor 37, and if the measured surface configuration of the abrasive disc 20 is not coincident with the desired configuration, the number of revolutions of the dressing member 11 is adjusted on the basis of the data shown in FIG. 8 relative to the number of revolutions of the turntable 24. Thus, the surface configuration of the abrasive disc 20 can be adjusted to that which is desired. When the polishing surface of the abrasive disc 20 assumes a general hill-like form in which the central portion is highest, the number of revolutions of the dressing member 11 is lowered relative to the number of revolutions of the turntable 24, whereby the polishing surface of the abrasive disc 20 is generally subject to valley-like wear in which the central portion of the surface is worn at the fastest rate. In this way, the abrasive disc 20 can be regenerated to have a flat polishing surface, thereby enabling the surface of the substrate W to be polished flat.

Figure 10A:
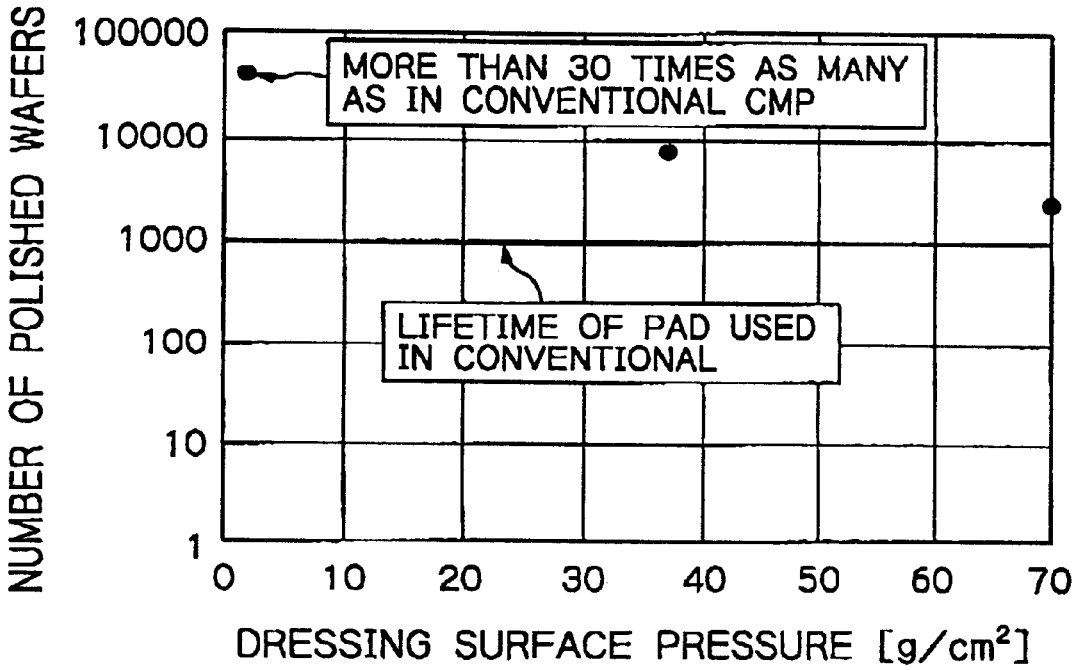
FIG. 10(*a*) is a diagram showing a relationship between the dressing surface pressure and the number of substrates polished.
Figure 10B:
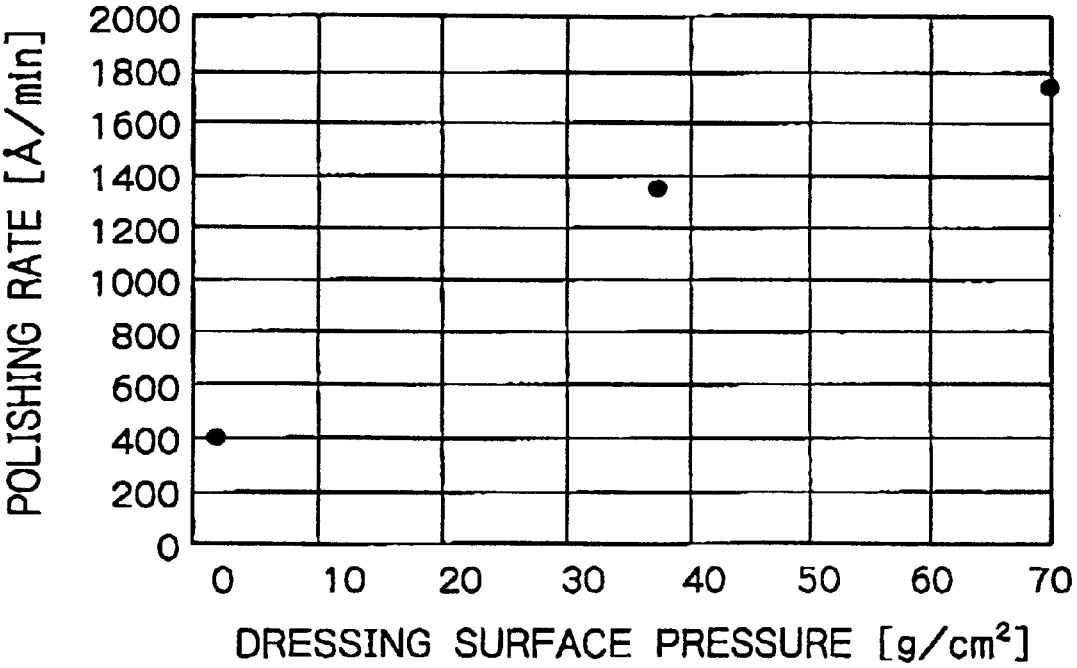

In the polishing process using an abrasive disc, if the abrasive disc is dressed under an excessively heavy load, an excessive amount of freed abrasive particles are generated, which results in excessive wear of the abrasive disc and a reduction in its working life. FIG. 10(*a*) shows the results of an experiment carried out to examine the relationship between dressing surface pressure and a number of wafers capable of being polished by one abrasive disc. As will be understood from the diagram, the working life of a pad used in conventional chemical/mechanical polishing (CMP) is 0 the order of 1,000 wafers regardless of dressing surface pressure. In the polishing process using a fixed abrasive disc, the number of wafers capable of being polished by one abrasive disc is consistently higher than can be achieved with a conventional CMP. When the surface pressure is low, i.e. 2 to 3 g/cm$^2$, the number of wafers able to be polished is in excess of 30 times that achievable by a conventional CMP. When the dressing surface pressure is 30 to 40 g/cm$^2$, the number of wafers able to be polished is 0 the order of 10 times that of a conventional CMP. When the dressing surface pressure is 70 g/cm$^2$, the number of wafers able to be polished is 9 the order of 2 to 3 times that of a conventional CMP. Thus, when a dressing surface pressure does not exceed 30 g/cm$^2$, the number of wafers able to be polished by one abrasive disc is in greater than 10 times that attainable when using a conventional CMP.

FIG. 10(*b*) is a diagram showing a relationship between the dressing surface pressure and the rate of polishing, in which the abscissa axis represents the dressing surface pressure, and the ordinate axis represents the polishing rate. That is, FIG. 10(*b*) shows the results of an experiment carried out to examine the relationship between dressing surface pressure and a rate of polishing for a blanket (with a flat film) wafer. When the dressing surface pressure is low, i.e. 2 to 3 g/cm$^2$, the polishing rate is low, i.e. about 400 Å/min., although the number of wafers that can be polished is more than 30 times that of a conventional CMP. In the process of polishing a patterned wafer, it is possible to obtain a polishing rate that is sufficiently high for practical applications. When the dressing surface pressure is increased to 30 to 40 g/cm$^2$, the polishing rate for the blanket wafer increases to about 1,400 A/min. Accordingly, in the polishing process using an abrasive disc, if the abrasive disc is dressed under excessive pressure, an excessive amount of freed abrasive particles are generated, resulting in undue wear and a reduced working life of the abrasive disc. Therefore, if the pressure applicable to the dressing member is limited to 30 g/cm$^2$, a stable polishing operation and increased working life of the abrasive disc can be attained.

Following is a description of a dressing method according to a fifth embodiment of the present invention. The dressing method is applied to a substrate polishing apparatus wherein an abrasive disc is brought into contact with a substrate under pressure. According to the dressing method, the abrasive disc is supplied with a liquid capable of dissolving a binder of which the abrasive disc is constituted, to thereby generate freed abrasive particles which function to dress the abrasive disc. When pure water is used as a polishing liquid, one of the following binders having high solubility in water is used to generate freed abrasive particles, thereby bringing about an effect equivalent to dressing. Preferable examples of binders having solubility in water are agar, starches, hydroxypropyl starch, sodium alginate, carboxymethyl starch ether, gum arabic, SMC (sodium carboxymethyl cellulose), methyl cellulose, partially-saponified PVA (polyvinyl alcohol), tragacanth, gelatin, collagen, casein, crystalline cellulose, carboxymethyl cellulose calcium, Tween, Pluronic, sodium laurate, carboxylic resin, ammonium sulfate, potassium chloride, salt, bentonite plus various chlorides, urea, anionic surface-active agent, glucose, sucrose, lactose, monosodium L-glutamate, sodium 5'-inosinate, dextrin, starches, corn starch, lime powder, phenol resin, furan resin, and isocyanate resin.

When a mixed liquid of water and alcohol is used as a liquid capable of dissolving a binder of which the abrasive 5 disc is constituted, it is preferable to use one of the following binders: PVP (polyvinyl pyrrolidone), HPMC (hydroxypropyl methyl cellulose), HPC (hydroxypropyl cellulose), PEG (Macrogol: polyethylene glycol), etc. When an acid solution is used as a liquid capable of dissolving a binder constituting the abrasive disc, the use of AEA (polyvinyl acetal diethylamino acetate) is effective. When an alkali solution is used as a liquid capable of dissolving a binder of which the abrasive disc is constituted, any of the following binders is effective: phenol, cellulose acetate phthalate, Eudragit L (methylmethacrylatemethacrylic-acid copolymer), and HPMCP (hydroxypropyl methyl cellulose phthalate). At the time of dressing an abrasive disc using one of the various binders mentioned above, a polishing solution active against the binder used is supplied to dissolve the binder, thereby enabling a self-dressing operation.

Figure 11:
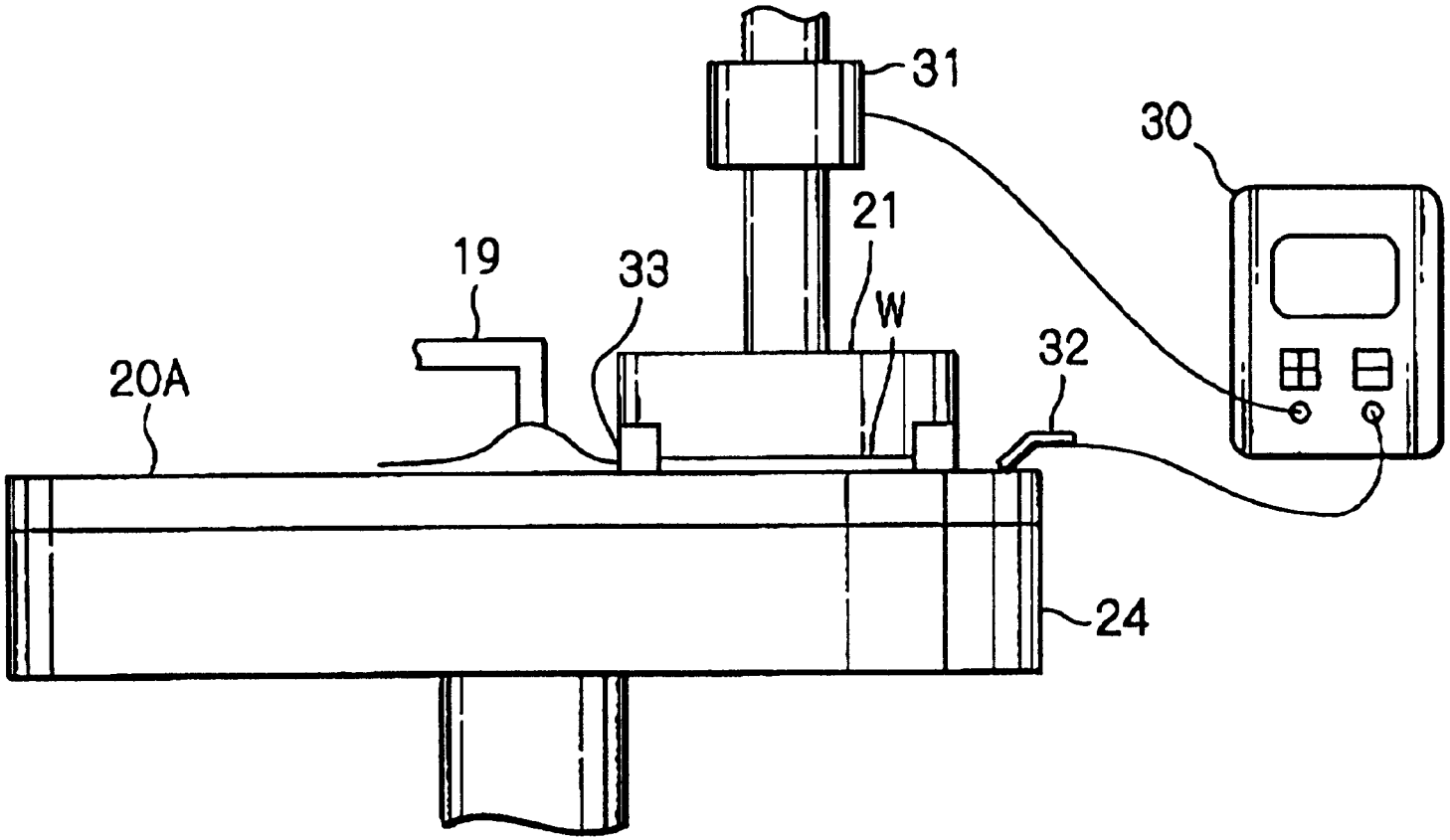
FIG. 11 is a side elevational view of a polishing apparatus in which a dressing method according to a sixth embodiment of the present invention is conducted.

FIG. 11 is a diagram describing a dressing method according to a sixth embodiment of the present invention. A polishing apparatus shown in FIG. 11 uses a metal bond as a binder constituting an abrasive disc 20A, whereby the bond of the binder is broken when an electric current is passed through the abrasive disc 20A, thereby promoting the generation of freed abrasive particles in a self-dressing operation. Examples of binders in which the bond is broken by the passage of an electric current include a cast iron bond, a fiber bond, an iron bond, a cobalt bond, and a composite bond of these materials. These materials are used as binders constituting the abrasive disc 20A, which is electrically conductive. In this polishing apparatus, an electric current is supplied from a power source 30 to a substrate carrier 21 through a rotary connector 31. The electric current flows into the electrically conducting abrasive disc 20A from an electrically conducting guide ring 33 and returns to the power source 30 from an electrode 32 connected to the abrasive disc 20A. In using the abrasive disc 20A, water is supplied during polishing while an electric current is supplied to the abrasive disc 20A from the power source 30 through the above-described path, thereby effecting polishing of the substrate W. The binder of the abrasive disc, consisting essentially of a metal bond, for example, undergoes ionization (electrolysis) in water which is supplied as a polishing liquid. Consequently, the bond of the binder is broken, thereby freeing abrasive particles in a self-dressing operation.

Figure 12:
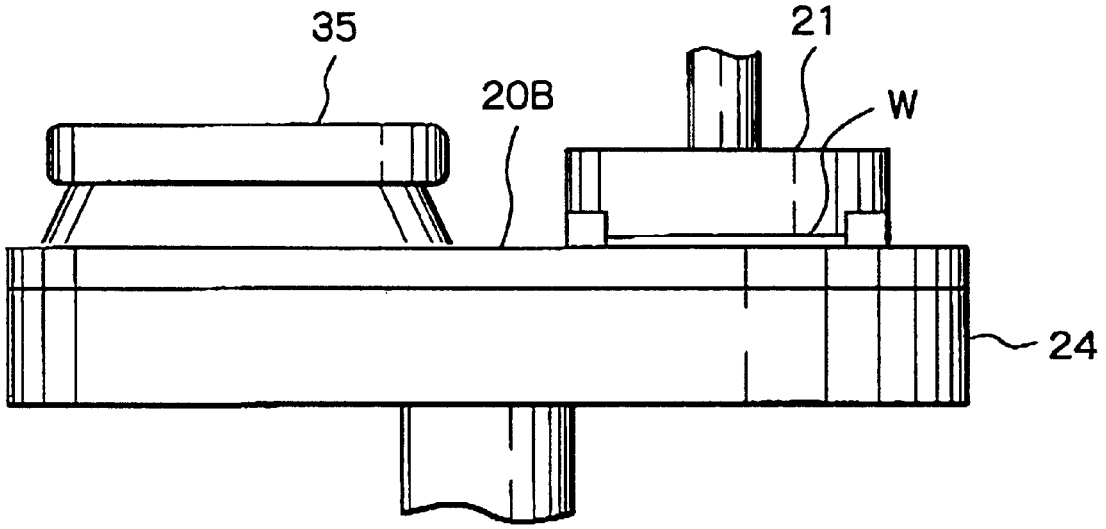
FIG. 12 is a side elevational view of a polishing apparatus in which a dressing method according to a seventh embodiment of the present invention is conducted.

FIG. 12 is a diagram describing a dressing method according to a seventh embodiment of the present invention. In this embodiment, as abrasive substances, $SiO_2$, $Al_2O_3$ or $CeO_2$ are used and, as a binder, a resin material, e.g. phenol or polyimide is used. Because the binder material is organic, when irradiated with light, the binder is decomposed by the photocatalytic substance, whereby bonding within the binder is broken and abrasive particles are freed. Further, by employing a photoreactive abrasive disc mixed with a photocatalytic substance, e.g. $TiO_2$or ZnO, as an abrasive disc 20B, it becomes possible to generate freed abrasive particles utilizing lower energy light rays. FIG. 12 illustrates an example of a polishing apparatus using the abrasive disc 20B. The polishing apparatus using the abrasive disc 20B has a light source. By irradiating the abrasive disc 20B with light rays generated from the light source 35, the bond in the binder material of the abrasive disc 20B is broken, thereby freeing abrasive particles in a self-dressing operation similar to that stated above. The arrangement of the apparatus for polishing a substrate W by slidingly engaging it with the polishing surface of the abrasive disc 20B under pressure, using a substrate carrier 21 holding the substrate W, exclusive of the light source 35, is similar to those of the above-described various polishing apparatuses. Thus, it is possible to perform in-situ dressing in which the substrate W, e.g. a semiconductor wafer, is polished with the abrasive disc 20B provided on a rotating turntable 24, while light rays are directed at the abrasive disc 20B from the light source 35, thereby dressing the abrasive disc 20B. It should be noted that a photodegradation substance, which is a photoresist material, may be used as a binder instead of mixing the material of the abrasive disc with a photocatalytic substance.

Figure 13:
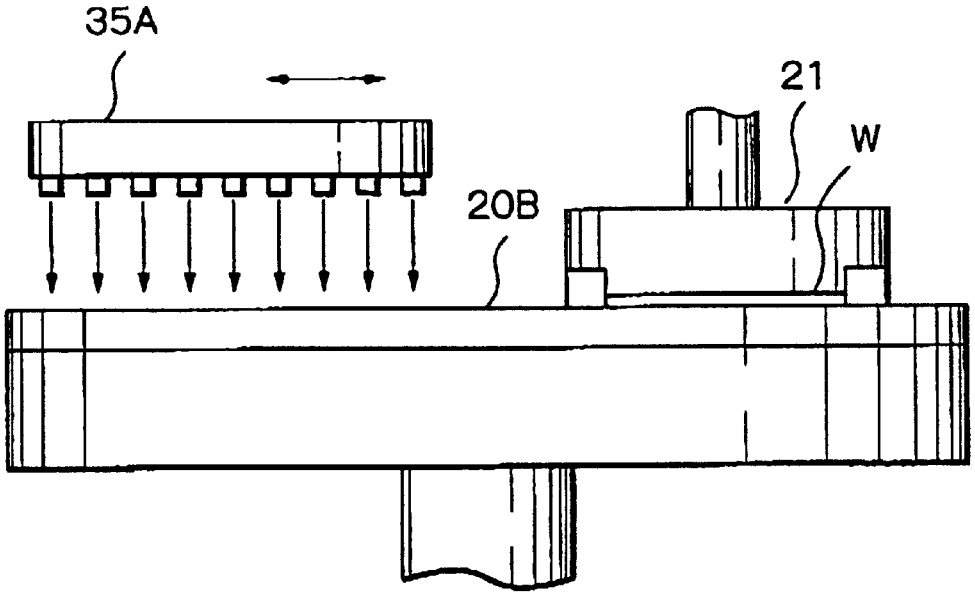
FIG. 13 is a side elevational view of a modification of the polishing apparatus illustrated in FIG. 12, in which a laser light source is used as a light source.

FIG. 13 is a diagram showing a modification of the polishing apparatus illustrated in FIG. 12. In this apparatus, a laser light source 35A is used as a light source to direct laser beams at the abrasive disc 20B. The laser light source 35A has a large number of laser beam outlets so that laser beams can be directed at an entire area of the abrasive disc 20B to be irradiated. The laser light source 35A is capable of oscillating in the directions indicated by the double-headed arrow in the figure. Thus, it is possible to avoid local concentration of laser beams and, at the same time, it is possible to impart a high density energy to the surface of the abrasive disc 20B by effecting irradiation with intense laser beams. Accordingly, efficient generation of freed abrasive particles can be attained. That is, a high degree of dressing can be attained.

Generally, when resin materials are used as a binder, materials such as compounds having C—H or C—C bonds are employed. By breaking C—H or C—C bonds existing in a surface of a binder constituting an abrasive member, and then binding desired functional groups to remaining bond arms, abrasive particles bound to the rigid base member by way of the binder are able to be released, thus generating freed abrasive particles. This brings about the same dressing effect as that brought about in a dressing operation by means of a conventional dressing member comprising diamond particles. Generally, C—H binding energy and C—C binding energy of resin materials are about 98 kcal/mol and about 80.6 kcal/mol, respectively. Thus, if light rays having a larger energy than the above-noted energies are directed to and absorbed by the binder to such an extent that the absorbed photon energy exceeds the above-noted binding energies, the molecular bond will be broken.

As light sources for effecting such molecular bond breaking, for example, KrF excimer laser light having a wavelength of 248 nm and photon energy of 114 kcal, ArF excimer laser light having a wavelength of 193 nm and photon energy of 147 kcal, and Xe excimer laser lamp light having a wavelength of 172 nm and photon energy of 162 kcal may be used. Although these light sources have a narrow wavelength distribution and are capable of generating high-energy light rays, they are expensive. Thus, as a low-cost dressing light source, a low-pressure mercury vapor lamp is often employed, which generates strong light rays having wavelengths of 253.7 nm and 184.9 nm (resonance lines of mercury) in spite of having a broad wavelength distribution.

As described above, for example, a C—C bond in a resin material has an energy of 80.6 kcal/mol and, thus, an energy required for generating freed abrasive particles can be calculated on the basis of the binding energy. Assuming that all photon energy of a light can be absorbed in a surface of an abrasive member to which the light is directed, the relationship between energy and wavelength, i.e. $E=h/v$ (h: Planck constant, v: velocity), dictates that irradiation with light having a wavelength of 351 nm or less enables breaking of the above-noted molecular bond.

However, in this connection there exists a problem in that the temperature of an abrasive member and a chemical liquid, and an abrasive liquid or the like on the abrasive member is raised under irradiation with high-energy light rays, which is liable to cause a change in properties. Such a change in properties is likely to impair the stability of abrasion or polishing performance. Thus, in the photo-dressing method described above, it is preferable to provide a cooling or temperature control system. The cooling or temperature control system may be of a heat-exchange type in which a coolant such as a cooled gas or liquid having a temperature lower than a room temperature is supplied in the form of a spray, a jet or the like. The cooling system may instead include a heat-exchanging member which is brought into contact with the chemical liquid, or the abrasive liquid or the like on the abrasive member and/or the abrasive member to thereby cool them. It is important that use of the coolant or the heat-exchanging member causes neither decomposition of the abrasive liquid, or the chemical liquid or the like on the abrasive member, nor any change in the density of the same, during a cooling operation employed to facilitate appropriate polishing by the abrasive member. Thus, providing a cooling effect by supplying an abrasive-aid agent such as a KOH liquid and an oxidizer and/or a dressing-aid agent such as a liquid having hydrophilic functional groups to be described later is preferable.

By directing photons from light sources to an abrasive member and an aqueous compound solution on the surface thereof, C—H and C—C molecular bonds in the surface of the abrasive member are broken, and the broken C—H and C—C molecular bonds are subjected to bonding with different molecules or atoms generated in the aqueous compound solution under photochemical reaction before occurrence of re-binding of the molecular bonds. As the aqueous compound solution, a solution having a capability to separate hydrophilic functional groups is suitable. In order to effect a stable abrasion or polishing operation by means of an abrasive member, it is preferable for the abrasive member to have a hydrophilic nature, whereby uniform polishing can be effected across an entire surface of an article to be polished without the abrasive liquid being repelled due to the hydrophilic nature of the abrasive member. Hydrophilic functional groups include —OH, —COOH, —$NH_2$, —CO, —$SO_3H$ and the like, and it is preferable to supply an aqueous compound solution capable of binding them to the abrasive member. Moreover, it is preferable to bind hydrophilic functional groups to abrasive particles by breaking molecular bonds under light ray irradiation in the same manner. Thus, the abrasion or polishing performance may be improved by employment of abrasive particles with the surface modified with hydrophilic functional groups.

Figure 14:
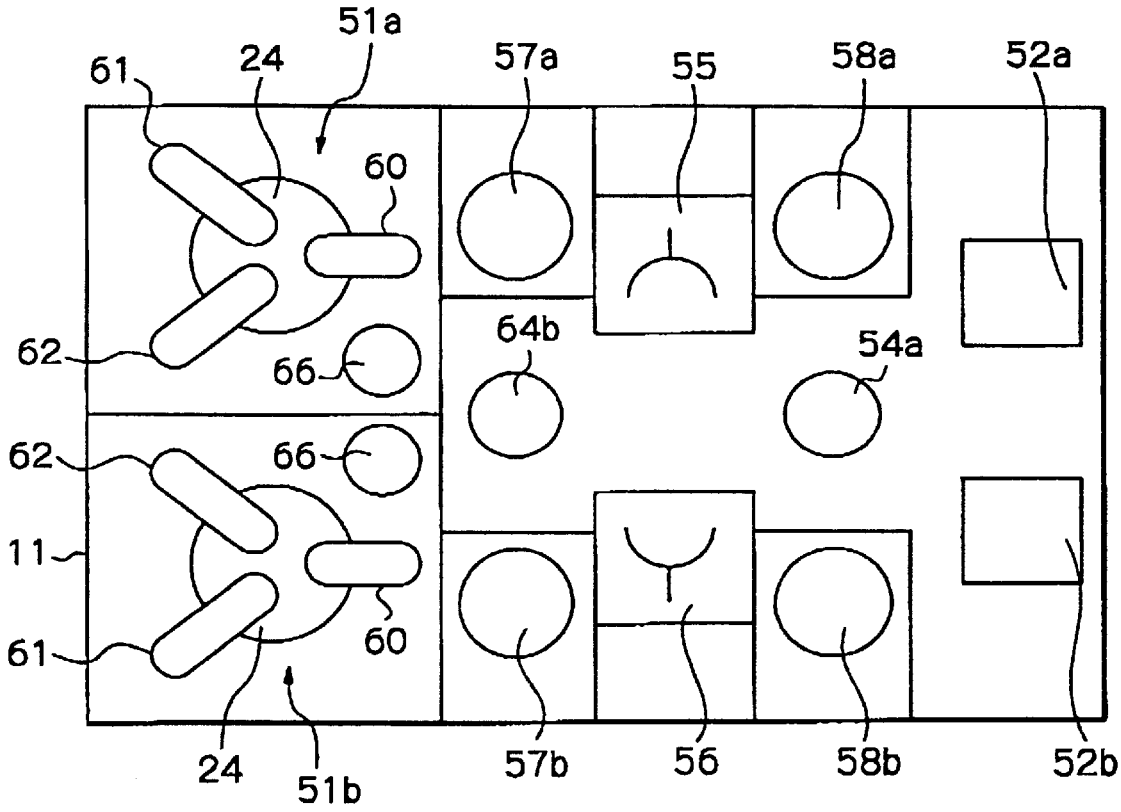
FIG. 14 is a plan view of a polishing apparatus provided with a photo-dressing device in accordance with the present invention.

FIG. 14 is a plan view of a polishing apparatus provided with a photo-dressing device in accordance with the present invention. As shown, the polishing apparatus is, as viewed in FIG. 14, rectangular as a whole and includes a pair of polishing units 51*a*, 51*b* positioned adjacent to each other on opposite sides of one end of the polishing apparatus and a pair of loading/unloading stations positioned at the other end of the polishing apparatus and adapted to receive wafer storing cassettes 52*a* and 52*b*. Along a center line connecting opposing ends of the polishing apparatus, there are provided wafer transfer robots 54a and 64*b*. Further, there are provided on either side of the center line pairs of cleaning devices 57*a*, 57*b* and 58*a*, 58*b*, with reversing device 55, 56 being interposed between the cleaning devices. The polishing unit includes a lift 66 for receiving a semiconductor wafer from the transfer robot 64*b* and transferring to a wafer carrier provided in the polishing unit and vice versa.

The polishing units 51*a* and 51*b* each include a turntable 24 provided with an abrasive disc, a wafer carrier 60 for carrying a semiconductor wafer and bringing it into contact with the abrasive disc, a conventional dressing device 61 comprising diamond particles adapted to be engaged with a surface of the abrasive disc to effect dressing, and a photo-dressing device 62 in accordance with the present invention for effecting photo-dressing as stated above. The turntables, the conventional dressing devices and the photo-dressing devices in the respective polishing units are symmetrically arranged relative to the center or wafer transfer line in the polishing apparatus.

Figure 15:
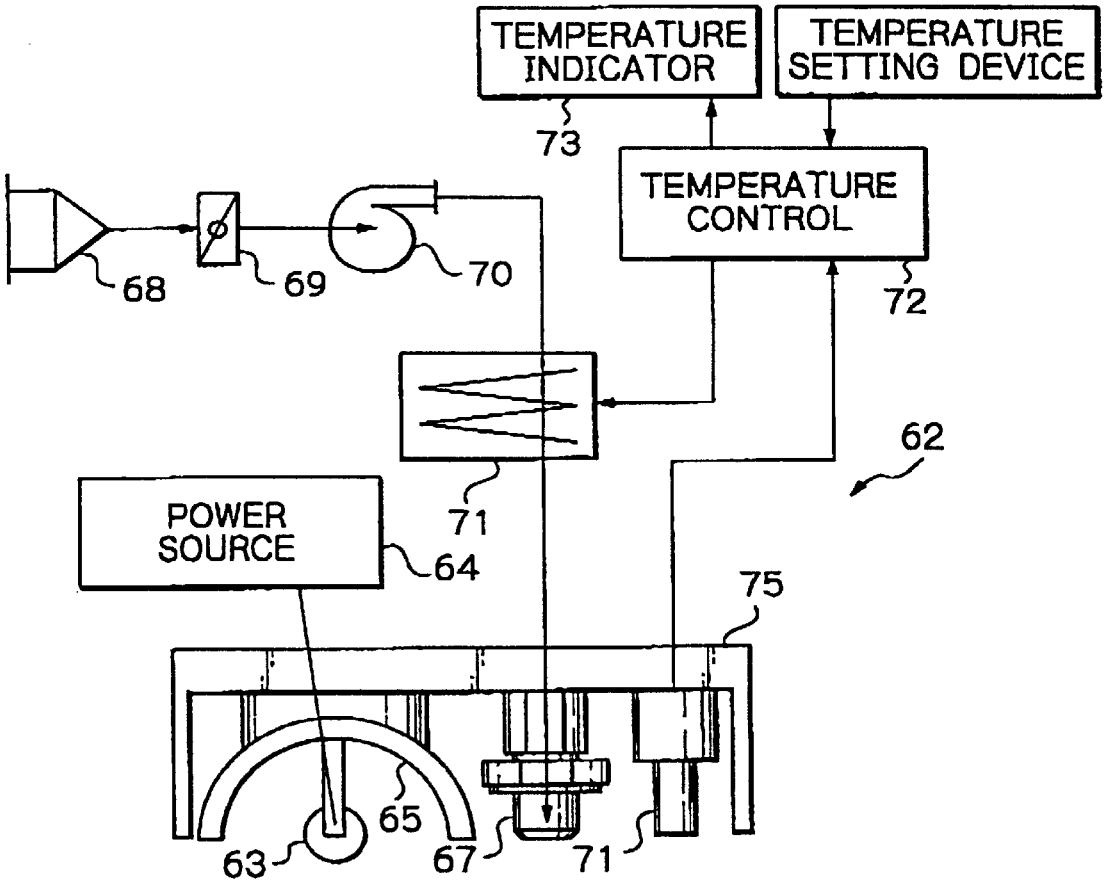
FIG. 15 is a schematical view of the photo-dressing device employed in the polishing apparatus of FIG. 14 showing an example of a construction of the dressing device.

FIG. 15 illustrates a constitutional example of the photo-dressing device 62. The photo-dressing device is equipped with, for example, a low-pressure mercury vapor lamp 63, which acts as a light source for irradiating a surface of an abrasive member to thereby promote the generation of freed abrasive particles from the abrasive member. A power source 64 is connected to the lamp 63 so as to supply an electric current thereto so that the lamp 63 generates short-wavelength light rays as stated above. The generated light rays are collected by a mirror 65 (an ordinary mirror or a cold mirror through which infrared light is able to pass) and directed to the surface of the abrasive member or disc. In addition, the dressing device 62 is equipped with an abrasive cooling system including a filter 68, a valve 69, a fan or blower 70, a heat-exchanger 71, and a jet nozzle 67, whereby a cooling gas is directed to a surface of an abrasive member through the jet nozzle 67 to prevent the surface of the abrasive member from being subjected to a rise in temperature. The dressing device 62 is further equipped with an infrared rays temperature sensor 71. The sensor 71 senses the temperature of the abrasive member surface and delivers signals representing the sensed temperature to a control circuit 72, whereby the signal is compared with a reference signal to thereby adjust the temperature of the cooling gas to a predetermined value. It is preferable for a temperature indicator 73 to be provided 20 so that the temperature of the surface of the abrasive member is always indicated.

Figure 16:
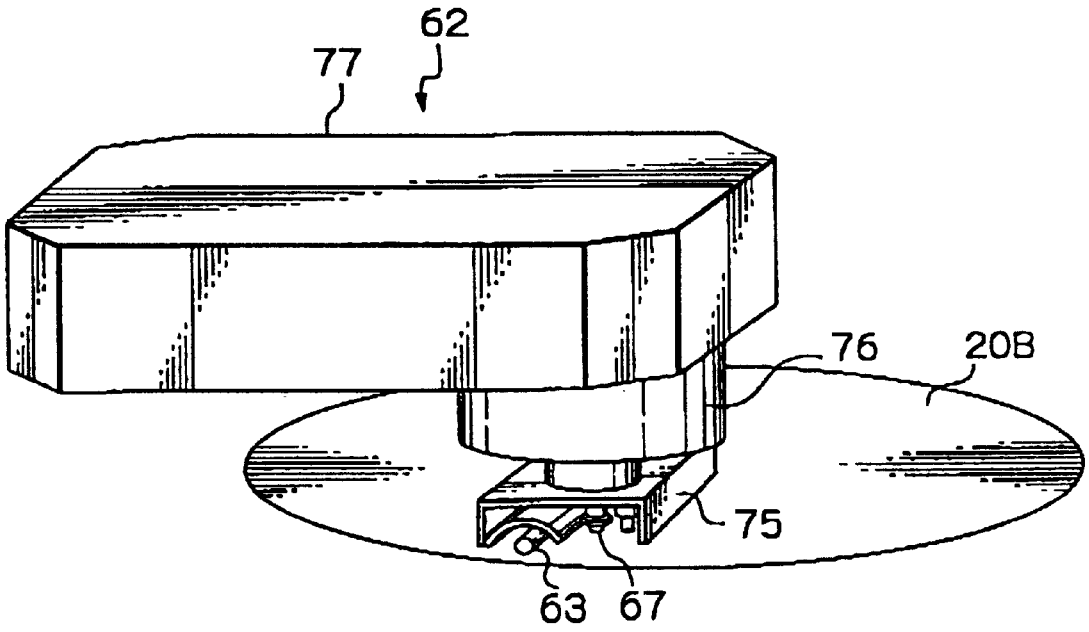
FIG. 16 is a perspective view of the photo-dressing device employed in the polishing apparatus of FIG. 14.

FIG. 16 is a perspective view of the photo-dressing device. The light source lamp 63 and the temperature adjustment gas jet nozzle 67 are provided in a cover member 75 which is fixedly connected to a pivotal arm 77 through a vertical cylinder/piston type actuator 76. The actuator 76 moves the cover member 75 with the light source lamp 63 and the jet nozzle 67 in a vertical direction to adjust the distance between the light source lamp 63 and the abrasion member surface to be dressed. The pivotal arm is pivotable about a vertical pivotal shaft (not shown) provided at the proximal end of the arm to determine a position of the abrasion member surface to be dressed.

Figure 17:
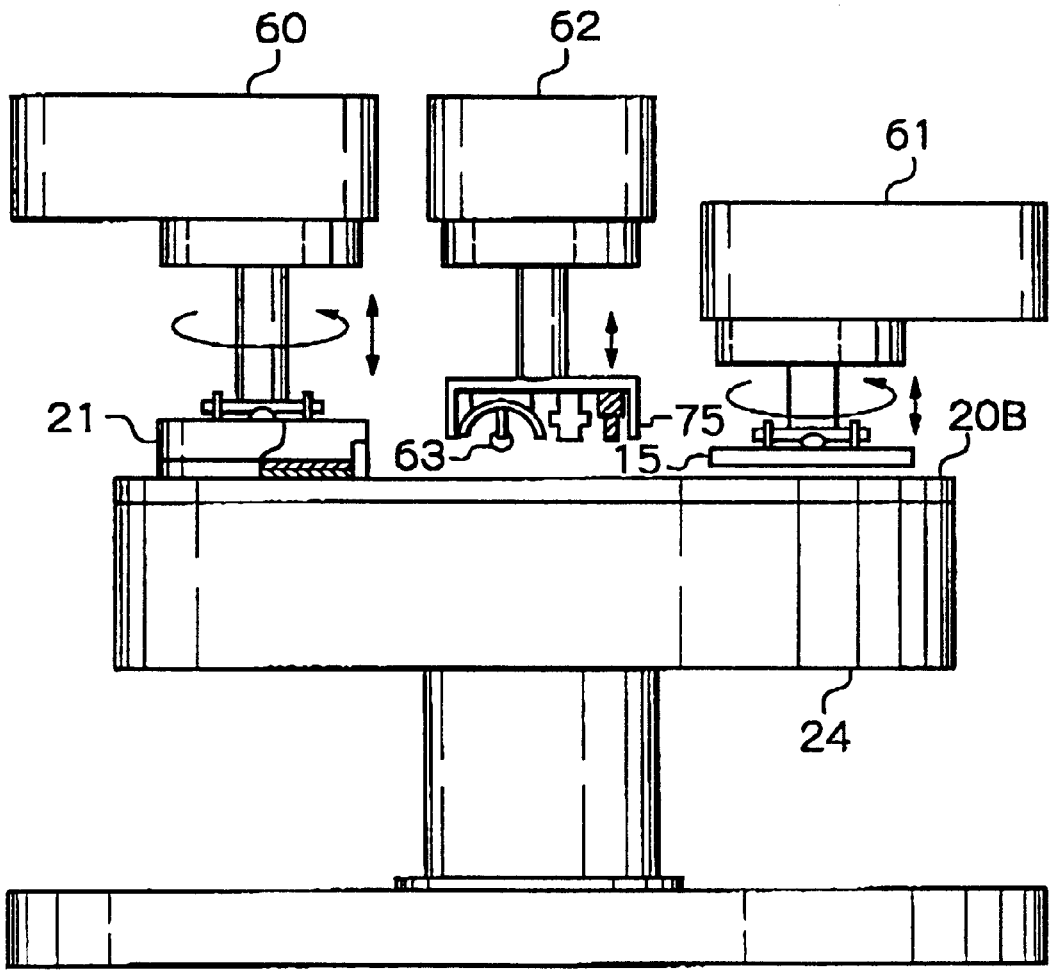
FIG. 17 is a side elevation view of a polishing unit in the polishing apparatus of FIG. 14.

FIG. 17 illustrates the polishing unit 51*a*. As stated 35 above, the polishing unit includes the turntable 24 provided with the abrasive member 20B and the wafer carrier 60 for carrying a semiconductor wafer, whereby the semiconductor wafer is polished by bringing the wafer into contact with the abrasive member 20B rotated together with the turntable. The polishing unit further includes the conventional mechanical dressing device 61 and the photo-dressing device 62 provided with the light source lamp 63 for, as stated above, effecting dressing by directing light rays to the polishing surface of the abrasive disc. The photo-dressing device is used before and/or during polishing. The conventional mechanical dressing device is used to flatten the entire polishing surface, typically when it is determined that the polishing surface contains significant undulations after polishing of a plurality of semiconductor wafers. The mechanical dressing device may be used in cooperation with a monitor for monitoring the condition of the polishing surface of the abrasive whereby undulations having a height or level difference of 1 micron or more are detected.

Figure 18:
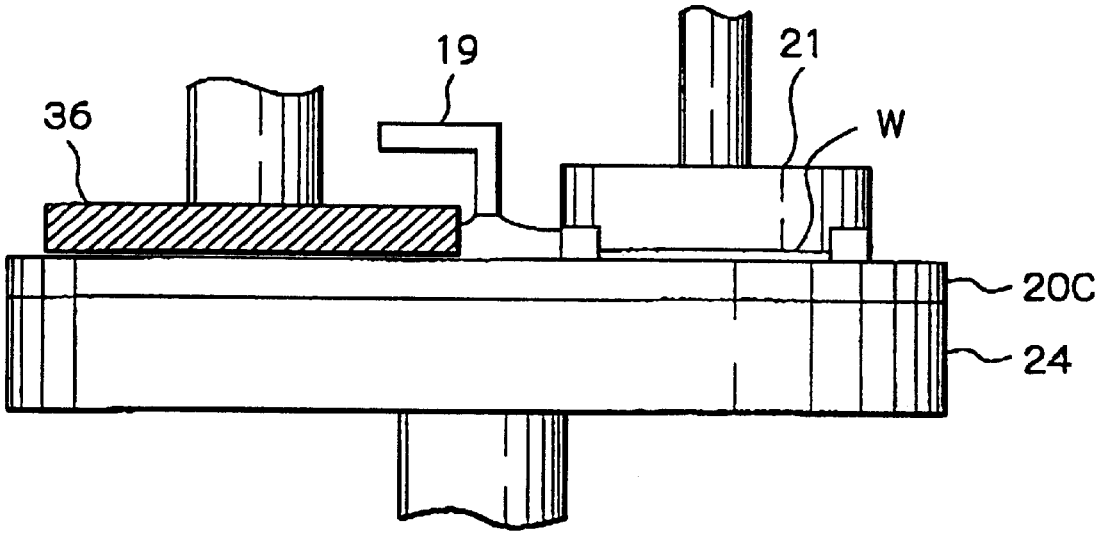
FIG. 18 is a side elevational view of a polishing apparatus provided with a dressing device according to an eighth embodiment of the present invention.

FIG. 18 is a diagram describing a dressing method according to an eighth embodiment of the present invention. In the illustrated polishing apparatus, an ultrasonic vibrator 36 is provided in place of the above-described light source 35 or 35A. When ultrasonic vibrations are imparted to an abrasive disc 20C, the bond within the binder is broken, thereby freeing abrasive particles to dress the abrasive disc 20C. Thus, the ultrasonic vibrator 36 has a similar function to that of the light source shown in FIG. 12 or 13. This apparatus also has a polishing liquid supply system 19 and a substrate carrier 21 for holding a substrate W to be polished, as in the case of the above-described apparatuses. In this apparatus also, by applying ultrasonic vibrations to the abrasive disc 20C from the ultrasonic vibrator 36, the bond within the binder is broken, thereby freeing abrasive particles and dressing the abrasive disc 20C. In the process, the substrate W to be polished is slidingly engaged with the abrasive disc 20C under pressure to thereby effect polishing of the substrate W, as in the embodiments stated above. It should be noted that in the fifth to eighth embodiments, mechanical dressing need not always be carried out in combination with the dressing process.

Figure 19:
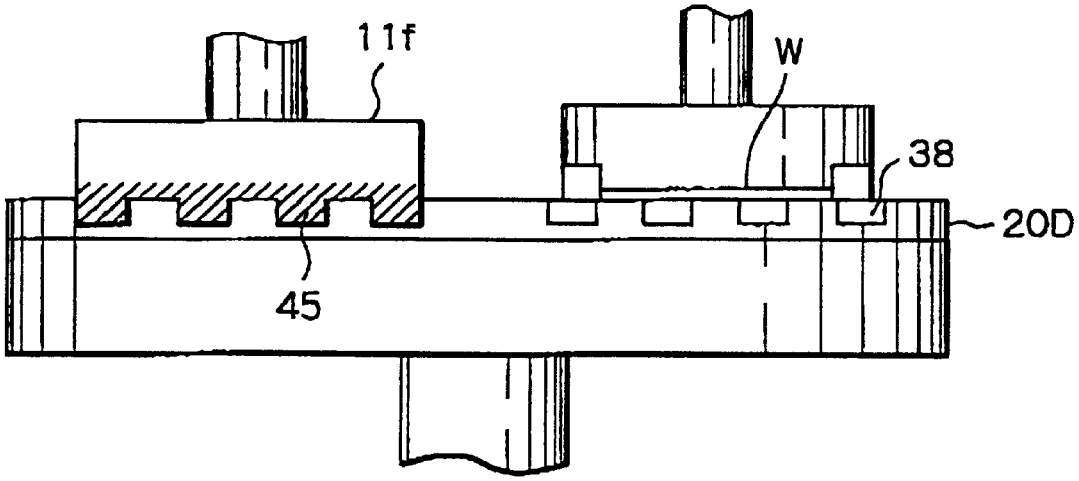
FIG. 19 is a side elevational view of a polishing apparatus provided with a dressing device according to a ninth embodiment of the present invention.

FIG. 19 shows a polishing apparatus according to a ninth embodiment of the present invention. In this polishing apparatus, an abrasive disc 20D has grooves 38 for discharging particles produced in polishing a substrate. However, wear of the abrasive disc 20D during use results in the grooves 38 being gradually denuded. Therefore, in this embodiment, a dressing member 11*f* is provided with projections 45 for regenerating or maintaining the discharge grooves 38. More specifically, the dressing member 11*f* is brought into contact with the abrasive disc 20D under pressure in such a manner that the projections 45 of the dressing member 11*f* are fitted in the discharge grooves 38 on the abrasive disc 20D to maintain the grooves in their 15 present state during dressing of the polishing surface of the abrasive disc 20D. In this embodiment, it is possible for the polishing apparatus of this embodiment to perform dressing of the abrasive disc simultaneously (in-situ) with polishing of a substrate.

Figure 20:
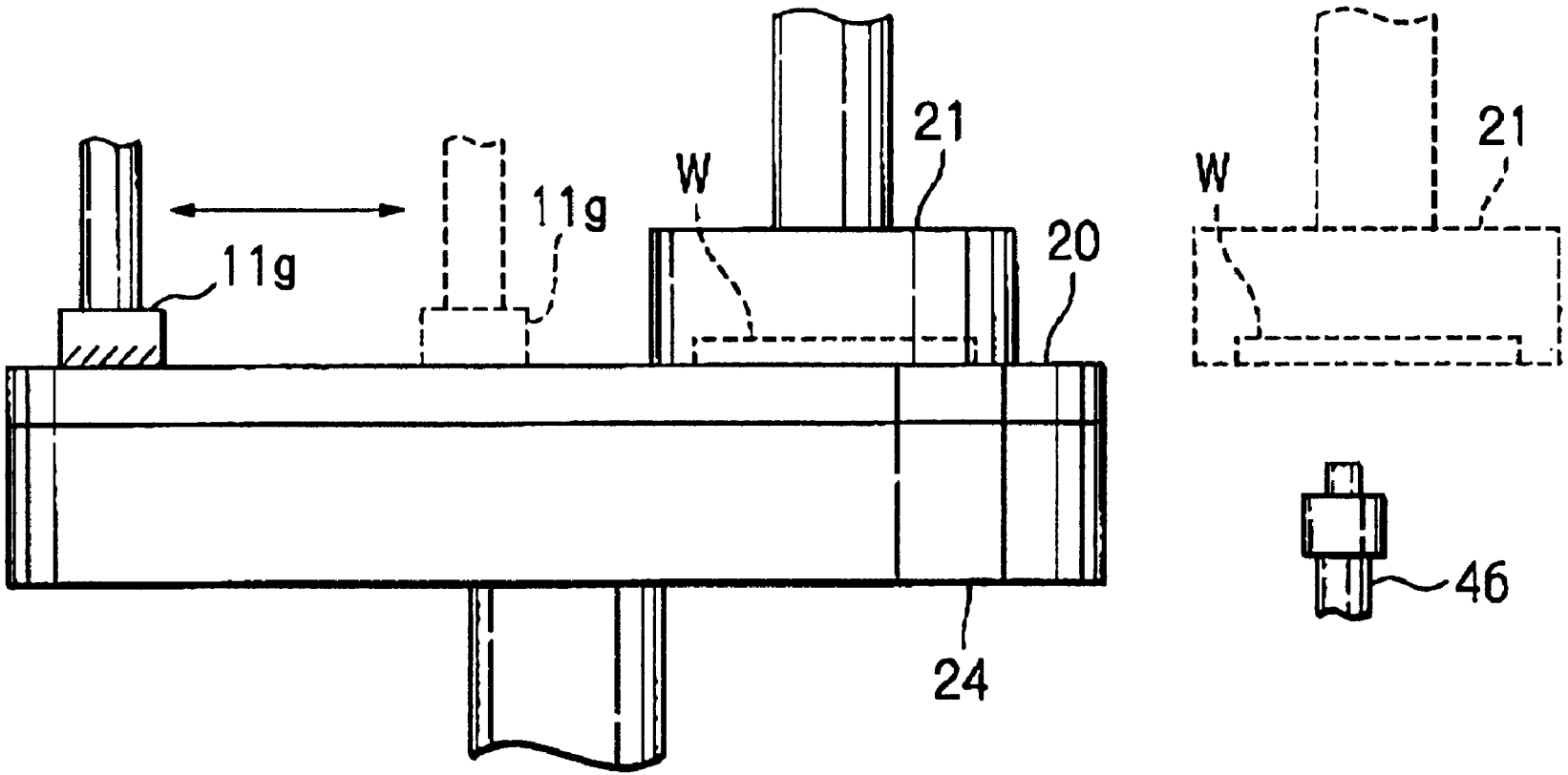
FIG. 20 is a side elevational view of a polishing apparatus provided with a dressing device according to a tenth embodiment of the present invention.

FIG. 20 shows a polishing apparatus according to a tenth embodiment of the present invention. The polishing apparatus has a dressing member 11*g* which has a smaller diameter than that of a substrate W to be polished and a mechanism (not shown) for oscillating the dressing member 11*g* in the directions indicated by the double-headed arrow in the figure, thereby allowing the position of the dressing member 11*g* to be controlled. The polishing apparatus further has a device 46 for measuring the polished surface configuration of the substrate W or a device for measuring the surface configuration of an abrasive disc and a controller (not shown) for moving the dressing member 11*g* on the basis of the surface configuration measured with the measuring device.

In polishing a substrate, the rate of polishing varies according to the amount of freed abrasive particles which have been detached from the abrasive disc. In order to provide a uniform polishing operation, in this embodiment, the device 46 measures variations in a polishing rate of the polished surface of the substrate W, and, on the basis of such a measurement, the dressing member 11*g* is moved to an area on the abrasive disc where a polishing rate is low so as to conduct selective dressing of the area, wherein abrasive particles are freed.

In the embodiments described above, the fixed abrasive member is a rigid plate comprising abrasive particles and a resin binder fixedly binding the abrasive particles. However, another type of fixed abrasive member may be employed which is referred to as a "fixed abrasive pad" in which a thin fixed abrasive layer is attached on an elastic layer.

As stated above, in accordance with the present invention, it is possible to perform efficient and appropriate dressing during a polishing process using a fixed abrasive member without any danger of causing damage in the form of scratches or the like to a surface being polished.

It should be noted that the present invention is not limited to the foregoing embodiments, but can be modified in a variety of ways.

What is claimed is:

1. In a substrate polishing process wherein a substrate is brought into engagement with a polishing surface of an abrasive member and subjected to a relative sliding motion there between, thereby causing the substrate to be polished, a method for dressing the polishing surface of the abrasive member comprising:

irradiating the polishing surface of the abrasive member with a light at least one of before and during polishing of a substrate, the abrasive member containing abrasive particles bound by a binder; and mechanically dressing the polishing surface to flatten the entire polishing surface after polishing of a plurality of substrates.

2. A method as set forth in claim 1, further comprising supplying a liquid to the polishing surface of the abrasive member during said irradiating of the polishing surface of the abrasive member with a light.

3. A method as set forth in claim 2, wherein said liquid comprises a chemical.

4. A method as set forth in claim 1, wherein said abrasive member comprises:

abrasive particles;

a binder for binding said abrasive particles; and a photocatalyst for promoting decomposition of the binder by irradiation of the binder.

5. A method as set forth in claim 4, wherein said binder material is resin.

6. A method as set forth in claim 4, wherein said photocatalyst comprises $TiO_2$ or ZnO.

7. In a substrate polishing process wherein a substrate is brought into engagement with a polishing surface of an abrasive member and subjected to a relative sliding motion there between, thereby causing the substrate to be polished, a method for dressing the polishing surface of the abrasive member comprising:

irradiating the polishing surface of the abrasive member with a light at least one of before and during polishing of a substrate, the abrasive member containing abrasive particles bound by a binder; and mechanically dressing the polishing surface to flatten the polishing surface when undulations having a height difference of at least one micron are detected on the polishing surface.

8. A method as set forth in claim 39, further comprising supplying a liquid to the polishing surface of the abrasive member during said irradiating of the polishing surface of the abrasive member with a light.

9. A method as set forth in claim 8, wherein said liquid comprises a chemical.

10. A method as set forth in claim 7, wherein said abrasive member comprises:

abrasive particles;

a binder for binding said abrasive particles, and a photocatalyst for promoting decomposition of the binder by irradiation of the binder.

11. A method as set forth in claim 10, wherein said binder material is resin.

12. A method as set forth in claim 10, wherein said photocatalyst comprises $TiO_2$ or ZnO.

13. In a substrate polishing process wherein a substrate is brought into engagement with a polishing surface of an abrasive member and subjected to a relative sliding motion therebetween, thereby causing the substrate to be polished, a method for dressing the polishing surface of the abrasive member comprising:

irradiating the polishing surface of the abrasive member with a light at least one of before and during polishing of a substrate, the abrasive member containing abrasive particles bound by a binder; and mechanically dressing the polishing surface to flatten the entire polishing surface when it has been determined that the polishing surface contains significant undulations.

14. A method as set forth in claim 13, further comprising supplying a liquid to the polishing surface of the abrasive member during said irradiating of the polishing surface of the abrasive member with a light.

15. A method as set forth in claim 14, wherein said liquid comprises a chemical.

16. A method as set forth in claim 13, wherein said abrasive member comprises:

abrasive particles;

a binder for binding said abrasive particles; and a photocatalyst for promoting decomposition of the binder by irradiation of the binder.

17. A method as set forth in claim 16, wherein said photocatalyst comprises $TiO_2$ or ZnO.

18. A method as set forth in claim 16, wherein said binder material is resin.

* * * * *